United States Patent [19]

Anderson

[11] Patent Number: 4,588,955

[45] Date of Patent: May 13, 1986

[54] TRANSVERSE FIELD FOCUSED SYSTEM

[75] Inventor: Oscar A. Anderson, Berkeley, Calif.

[73] Assignee: The United States of America as represented by the United States Department of Energy, Washington, D.C.

[21] Appl. No.: 500,105

[22] Filed: Jun. 1, 1983

[51] Int. Cl.[4] ..... H01J 23/00

[52] U.S. Cl. ..... 328/233; 250/423 R; 376/130

[58] Field of Search ..... 250/251, 396 R, 398, 250/423 R; 313/231.01, 361.1; 376/101, 116, 117, 127, 129, 130, 287; 315/111.81; 328/233

[56] References Cited

U.S. PATENT DOCUMENTS

| | | | |
|---|---|---|---|
| 2,932,745 | 4/1960 | Alberti et al. | 376/287 |
| 2,942,115 | 6/1960 | O'Connell | 376/287 |
| 3,094,474 | 6/1963 | Gale | 250/396 R |
| 3,120,470 | 2/1964 | Imhoff et al. . | |
| 3,218,562 | 11/1965 | Serduke . | |
| 3,235,463 | 2/1966 | Sankovich | 376/287 |
| 3,379,911 | 4/1968 | Enge | 250/398 |
| 3,660,658 | 5/1972 | Leboutet et al. | 250/398 |
| 3,734,827 | 5/1973 | Schilling | 376/287 |
| 4,134,017 | 1/1979 | Azam et al. | 250/398 |
| 4,347,621 | 8/1982 | Dow . | |
| 4,434,131 | 2/1984 | Dagenhart et al. | 376/130 |
| 4,439,395 | 3/1984 | Kim | 376/130 |
| 4,480,185 | 10/1984 | Hashimoto | 376/130 |

OTHER PUBLICATIONS

Nagy et al., "Introduction to the Theory of Space--Charge Optics," pp. 384–389.

Hogg, "Periodic Electrostatic Beam Focusing," IEE, Feb. 1959, pp. 1016–1020.

Kirsten et al., "Space Charge Flow," 1967, pp. 254–271.

Anderson et al., "Negative-Ion-Based Neutral Beam System for Fed-A Current Drive," LBL-14880, Aug. 1980.

Anderson et al., "A Transverse-Field-Focusing (TFF) Accelerator for Intense Ribbon Beam," LBL-15172, Mar. 1983.

Abramyan, "Transformer Type Accelerators for Intense Electron Beams," pp. 447–455 (1971).

*Primary Examiner*—Deborah L. Kyle

*Assistant Examiner*—Richard W. Wendtland

*Attorney, Agent, or Firm*—Clifton E. Clouse, Jr.; Roger S. Gaither; Judson R. Hightower

[57] ABSTRACT

A transverse field focused (TFF) system for transport or acceleration of an intense sheet beam of negative ions in which a serial arrangement of a plurality of pairs of concentric cylindrical-arc electrodes is provided. Acceleration of the sheet beam can be achieved by progressively increasing the mean electrode voltage of successive electrode pairs. Because the beam is curved by the electrodes, the system can be designed to transport the beam through a maze passage which is baffled to prevent line of sight therethrough. Edge containment of the beam can be achieved by shaping the side edges of the electrodes to produce an electric force vector directed inwardly from the electrode edges.

5 Claims, 6 Drawing Figures

TRANSVERSE FIELD FOCUSED SYSTEM

The U.S. Government has rights in this invention pursuant to contract no. DE-ACO3-76SF00098 between the U.S. Department of Energy and the University of California.

BACKGROUND OF THE INVENTION

The present invention relates to transport and acceleration systems for charged particles and more particularly to electrostatic systems utilizing transverse field focusing (TFF) for transport and acceleration.

It is anticipated that magnetically confined plasmas in fusion reactors can be heated to fusion temperatures, and maintained for sustained operation, by the injection of powerful beams of neutral hydrogen or deuterium atoms. The injected particles must be electrically neutral so that they will not be prematurely deflected by the strong magnetic fields in the reactor which confine the plasma. However, in order for the injected particles to have the required level of kinetic energy, they must initially have an electric charge to enable them to be accelerated to that level.

Considerable developmental work has been done on high-current negative ion sources and on neutralizing systems for converting high current negative ion beams to neutral atoms by electron stripping.

The present invention is particularly directed to apparatus that can be used to transport the high-current negative-ion beam from the negative-ion source to the neutralizer, and that can provide the desired acceleration to the beam.

The problems involved in providing suitable apparatus for this purpose are considerable.

For example, the very high ion current required is constituted by a tremendous number of ions of like charge which repel each other and cause the ion beam to diverge and expand. The transport and acceleration apparatus must be able to confine the beam against divergence and expansion on its travels through the system.

After the negative ion beam has been neutralized, it must follow a straight line trajectory into the fusion reactor through a penetration in the reactor shielding. Neutrons in the reactor can, of course, exit via the same shielding penetration. If the escaping neutrons are able to reach the negative ion source equipment, such equipment will become radioactive by neutron activation, and must be remotely maintained. In order to prevent this severe problem, the negative-ion beam transport apparatus must be capable of transporting the negative-ion beam through a maze path in the neutron shielding, before the beam is neutralized, so that there is no direct line of sight from the interior of the fusion reaction to the ion source and other apparatus which must be maintained free of neutron radiation.

For efficient operation, background gas molecules must be removed before acceleration of the beam to, and transport of the beam at, high-energy levels. In order to accomplish this, the transport apparatus must enable the beam to bend around corners to follow a maze path through the baffles of a differential pump while allowing gas molecules to exit freely from the transport apparatus for movement to the cryopump panels.

Very high acceleration voltages are required for fusion reactor applications, e.g., in the range of 400–800 kV. If such voltages are used in a one-stage accelerator, it is extremely difficult to prevent sparking between electrodes. Conventional multi-stage accelerators can reduce arcing break-down by reducing the voltage difference per stage, but with a significant sacrifice in beam current.

SUMMARY OF THE INVENTION

It is an object of the invention to provide a transport apparatus for a high current negative-ion beam which will bend the beam around corners through a baffled path in a differential pump or a neutron trap.

It is another object of the invention to provide a transport apparatus for a high current negative-ion beam which will allow gas molecules in the beam to exit outwardly from the transport apparatus.

A further object of the invention is to provide a multi-stage accelerator for a high current negative-ion beam which will enable acceleration of the beam to very high energy levels with a minimum loss of current carrying capacity.

A still further object of the invention is to provide an apparatus for transport or acceleration of a sheet beam of negative ions which is shaped to confine the beam against divergence or expansion.

Additional objects, advantages and novel features of the invention will be set forth in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, a transverse field focused system for use with a source of a sheet beam of charged particles is provided, such system having a plurality of pairs of electrodes formed with spaced-apart concentric cylindrical-arc electrode surfaces, the pairs of electrodes being arranged in serial manner, and means for impressing voltages on the electrodes of each pair to guide the sheet beam between the electrodes and along a curved surface between the electrodes.

In order to provide acceleration of the sheet beam, the mean voltage applied to successive pairs of electrodes is progressively increased.

In order to provide against outward spreading of the sheet beam, both side edges of both electrodes of a pair thereof are bent toward the axis of curvature of the electrode surfaces thus providing inward electric forces to focus the beam edges.

BRIEF DESCRIPTION OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
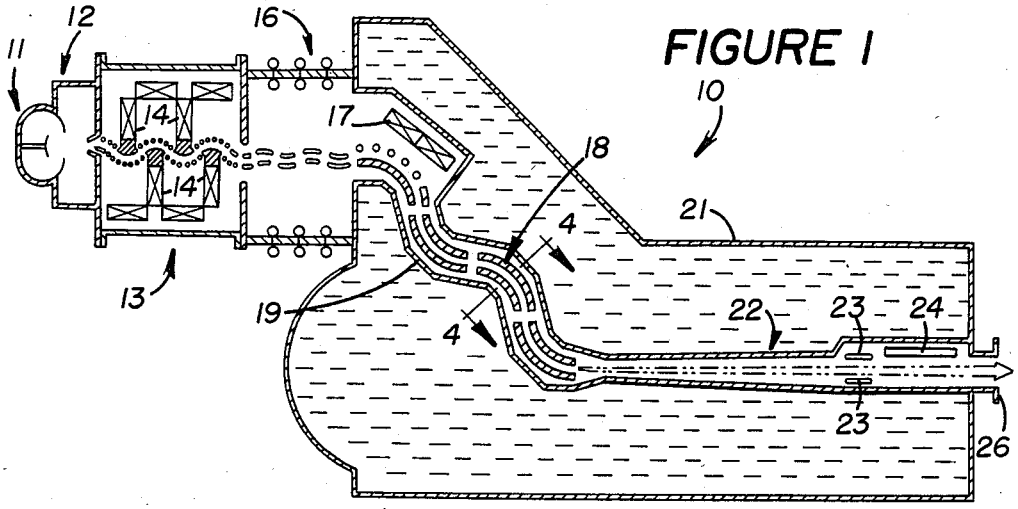
FIG. 1 is a sectional and partly schematic view of a neutral beam injection system utilizing TFF transport and accelerating sections operating in accordance with the invention.

Referring now to the drawings, which illustrate a preferred embodiment of the invention, the neutral beam injection system 10 is designed to inject a powerful sheet beam of neutral hydrogen or deuterium ions into the interior of a fusion reactor (not shown).

The system 10 includes a negative ion source 11 and a pre-accelerator 12. These units are only shown generally herein, since the specific details of these units form no part of the present invention. The negative-ion source 11 may be a surface-conversion unit wherein a plasma is produced in a magnetic bucket by a hot cathode discharge, and negative ions are produced on a negatively-biased cesiated molybdenum converter, the negative ions being accelerated through the potential difference between the converter and plasma. Such a source can produce a sheet beam of negative ions in the order of about 1 meter wide, with $D^-$ yields being approximately 70% of the $H^-$ yields, and with an equivalent $H^-$ current in the order of about 8 amperes. The sheet beam then passes through the pre-accelerator 12, which may be of a high perveance single-aperture design. In the system shown, the pre-accelerator 12 is designed to accelerate the ion beam to an 80 keV energy level.

After acceleration by the pre-accelerator 12, the ion beam enters the transport and pumping section 13, wherein the transverse field focusing principle is used to transport the beam in a sinuous manner through a maze, or baffled arrangement, of cryogenic pump panels 14. Typically, the ion source 11 operates at a pressure in the order of $10^{-3}$ torr, with the cryopumps being capable of removing gas molecules from the ion beam so that the pressure is lowered to about $10^{-6}$ torr.

The ion beam then passes through a TFF accelerator section 16, wherein the transverse field focusing principle confines the beam during acceleration to a high energy level, e.g., in the order of 400–800 keV. After acceleration, the ion beam preferably passes by another cryopump panel 17 before the beam is transported by the TFF transport section 18 through multiple bends in a channel 19 through the neutron shield 21. These bends prevent line-of-sight streaming of neutrons and greatly attenuate the neutron flux from the reactor into which the ion beam is injected. The neutron shield 19 is a double-walled chamber preferably constructed of low-activation 5254 aluminum alloy, with the volume between the walls being filled with borated water for neutron moderation and absorption.

After transport around the final bend of channel 19, the negative-ion beam passes through a neutralizer section 22 wherein the negative ions are converted to neutral atoms. The neutralizer section 22 may be the resonant cavity of a laser wherein approximately 97% of the negative ions are converted to neutral atoms by electron photo-detachment. Oxygen-iodine chemical lasers operate at a wavelength of 1.3 microns, which corresponds to a photon energy adequate to remove the electron from a $D^-$ ion, but inadequate to strip the electrons from common impurity ions such as $O^-$ and $OH^-$, or to create $D^+$ ions. The ion beam in the neutralizer is in the order of 1 m wide (i.e. into the plane of FIG. 1), but is quite thin (a few cm) in the narrow direction (in the plane of FIG. 1), which permits efficient use of the laser. The narrow cross section of the laser cavity also permits deflection of the remaining 3% of the negative ions and any impurities by electrostatic plates 23 into an ion dump 24 at one side of the beam.

The resulting neutral beam is then injected, from outlet 26 of the neutron shield 21, into a fusion energy device (not shown) to provide startup heating and/or current drive in the reactor.

Figure 2:
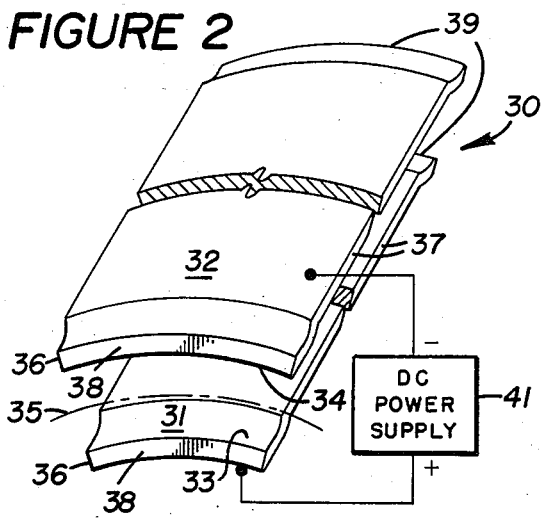
FIG. 2 is a simplified perspective and schematic view of a solid plate form of electrodes used for transport or acceleration of a negative-ion beam.

The TFF transport and acceleration sections described above utilize serially arranged pairs 30 of suitably biased and curved electrodes. One of such pairs 30 of electrodes is illustrated for definitional purposes in FIG. 2. As there seen, the pair of electrodes 30 includes inner and outer electrodes 31 and 32 having opposed and spaced apart inner and outer surfaces 33 and 34 which are shaped as concentric cylindrical-arc segments. In use, the negative-ion beam will be transported from left to right in FIG. 21 between the electrodes and centered and guided along an imaginary mid surface (indicated by line 35) between the electrodes, such surface being a cylindrical-arc segment with a radius of curvature $r_m$ equal to the sum of the radii of curvature of the inner and outer electrode surface 33 and 34. The inner and outer electrodes 31 and 32 each have entry and exit edges 36 and 37 parallel to the axis of curvature and side edges 38 and 39 in planes perpendicular to the axis of curvature of the electrodes. The electrodes have a width in a direction parallel to the axis of curvature, a length in the direction of negative ion beam transport and a gage spacing, G, in a direction radially of the axis of curvature. When pairs 30 of electrodes are arranged serially with the negative-ion beam moving from one pair of electrodes to the next pair, the two pairs of electrodes will have a gap spacing between the exit edges of one pair and the entry edges of the next pair.

Each pair of electrodes will be electrically connected to a dc power supply 41. For a system with negatively charged particles, the inner electrode 31 is at a more positive potential then the outer electrode so that the electrostatic lines of force will be directed towards the inner electrode to cause the beam to curve towards the inner electrode.

Each pair of electrodes will serve to focus the beam in a radial direction since whenever a sheet beam of charged particles is made to follow a curved path by the action of electrostatic fields, charged particles away from the central lamina of the beam will be urged towards it.

Figure 3:
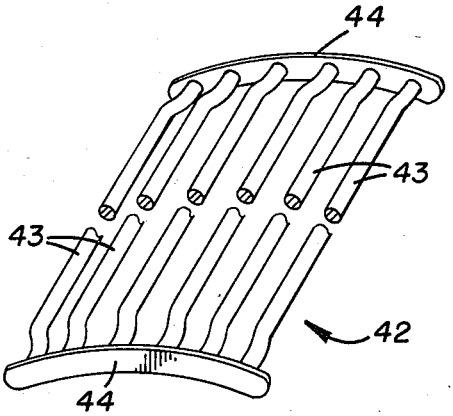
FIG. 3 is a simplified perspective view of a parallel rod form of electrode usable for transport or acceleration of charged particles in regions where gas pumping is needed.
Figure 5:
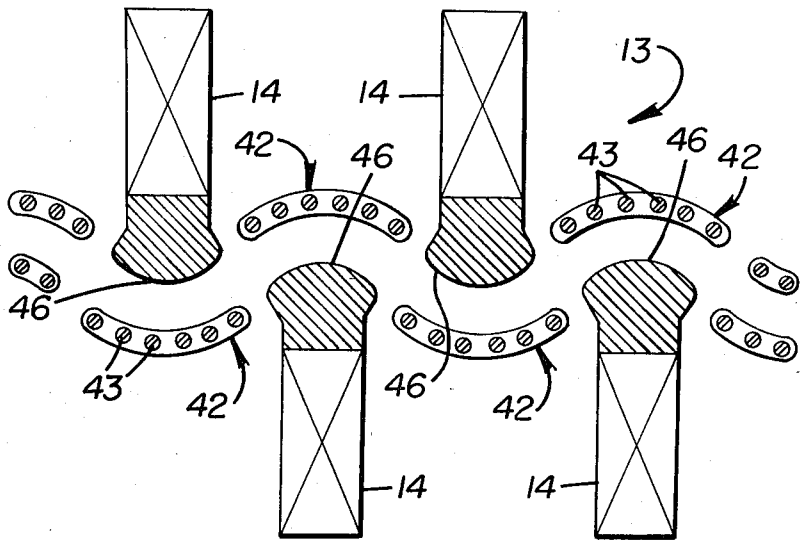
FIG. 5 is a generally sectional and schematic view of a portion of the transport and pumping section of FIG. 1.

Physically, the electrodes of each pair may be of considerably different construction. For example, in FIG. 2 the electrodes 31 and 32 are shown as solid plates. However, if desired, the electrodes may be constructed as in FIG. 3, wherein the electrode 42 is formed by a plurality of parallel rods 43 supported by opposed headers 44, as long as the rods are closely enough spaced from each other so that a sufficiently uniform electrostatic field is formed between the electrodes in each pair thereof. FIGS. 1 and 5 show the use of parallel-rod electrodes 42 in the transport and pumping section 13, wherein the inner and outer electrodes of a pair 30 are formed by a curved solid cap 46 and a parallel rod electrode 42, respectively. With a more positive potential on the caps 46 than on the electrodes 42, the negative-ion sheet beam will be guided through the pairs of electrodes. Gas molecules, however, are free to move outwardly through the spaces between the parallel rods so that the molecules can move into adhering contract with cryopump panels 14.

In designing a TFF transport or accelerator section, a consideration of the sheet beam dynamics in the region between cylindrical-arc electrodes and a concentric ion trajectory at the mean radius $r_m$ indicates that the kinetic energy, $mv^2/2$, of the beam is equal to $-q\phi m$, where q is the space charge of the total beam and $\phi_m$ is the potential at $r_m$ that results from the electrode potentials and the space charge. Then, in order to curve the beam with this amount of kinetic energy along the arc $r_m$, the following radial electric field $E_m$ is required:

$$E_m=2\phi m/r_m \tag{1}$$

If +U and −U are the voltages of the two electrodes, relative to the mean beam potential, then, to a good approximation, $$E_m=2U/G, \tag{2}$$

G being the gage, or radial spacing, between the electrodes.

Figure 4:
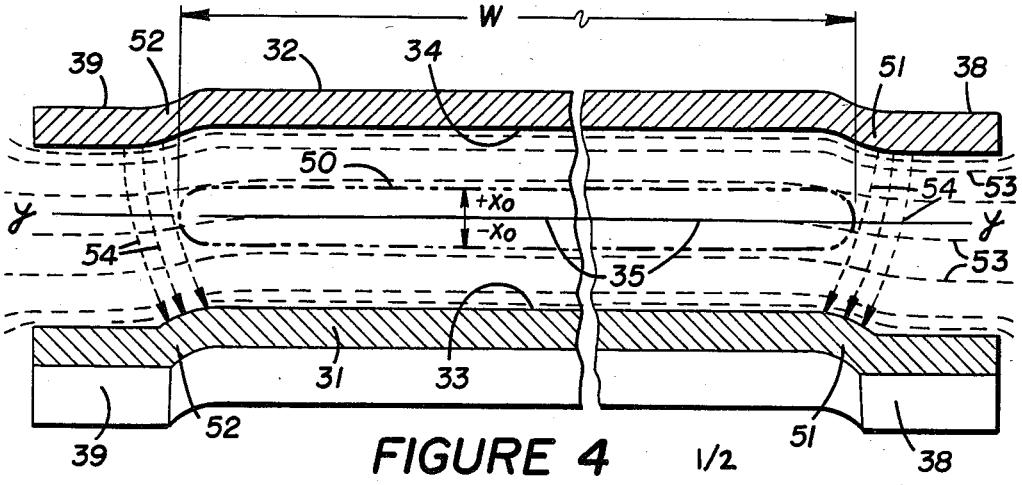
FIG. 4 is a transverse sectional view of a pair of spaced plate electrodes taken on line 4—4 of FIG. 1.

If the thickness of the sheet beam, measured in a radial direction, is equal to $2x_o$, then the gage of the electrodes should be about $6x_o$, in order to space the electrodes sufficiently far from the negative-ion beam to provide a suitable safety factor in case of beam envelope oscillations or for a halo from aberrations in the injected beam. As seen in FIG. 4, with a sheet beam thickness of $2x_o$, there will be a space $2x_o$ between the upper surface of the sheet beam 50 and the surface 34 of the upper electrode 32, and an equal $2x_o$ spacing between the sheet beam and the inner electrode surface 33. With such spacings as a safety factor, $$E_m=2U/6x_o, \tag{3}$$

and thus, $2U/6x_o=2\phi m/r_m$. (4)

In a sheet beam system using concentric cylindrical-arc electrodes, the maximum current density $J_{max}$ is equal to $9J_{CL}$, where $J_{CL}$ is the Child-Langmuir current density for a plane cathode and a parallel plane plate at a distance $r_m$ from it.

A correction factor mst be applied to the maximum current density to compensate for the weakening of the average field because of the field reversal at the gaps between adjacent pairs of electrodes. In practice, such field reversals will cause approximately a 15% reduction in maximum current density.

A correction must also be made for emittance. After optimizing for minimal potentials or electrodes, a correction factor of $\frac{2}{3}$ is obtained.

With these correction factors, the corrected current density is $$J_{corr}=0.85\times\tfrac{2}{3}\times 9J_{CL}=5.1J_{CL}. \tag{5}$$

The total current, I, depends on the width, W, of the beam and its thickness, $2x_o$, and can be expressed as $$I=J_{corr}(2x_o)(W). \tag{6}$$

From the Child-Langmuir equation, $$J_{CL}=\frac{C_{CL}(\phi_m)^{3/2}}{r_m^2}, \tag{7}$$

where $C_{CL}$ is the Child-Langmuir constant.

As a consequence, $$\frac{I}{2x_oW}=\frac{5.1\ C_{CL}(\phi_m)^{3/2}}{r_m^2}. \tag{8}$$

Equations (4) and (8) above both relate $x_o$ and $r_m$ to each other, thus enabling these dimensions to be determined if the other parameters are known. The total current, I, and the beam width, W, are both determined by the parameters of the negative-ion source 11. In the system described above I equals 8 amperes and W equals 1.1 meter. The value of $\phi_m$ depends on energy level of the beam and which is desired at a particular point in the system. For example, in the transport and pumping section 13, the beam is at an 80 kV level, and thus $\phi_m$ would be 80 kV in that section. The value of $\phi_m$ increases to 400 kV in accelerator section 16, and is 400 kV in the transport section 18. The value of U is determined to a large extent by practical considerations, such as insulator design, and is typically 30 to 50 kV.

By way of example, for the above parameters, and with values of 351 kV and 451 kV applied respectively to the inner and outer electrodes of the last pair in accelerator section 16, the values of $2x_o$ and $r_m$ are equal to 1.43 cm and 34 cm.

A typical minimum thickness of the neutron shield 21 is in the order of 1 meter. The ability of the electrodes pairs to bend the beam for transport through the neutron shield with a radius that is commensurate with the thickness of the shield is very advantageous in that it allows a compact maze path to be designed.

Figure 6:
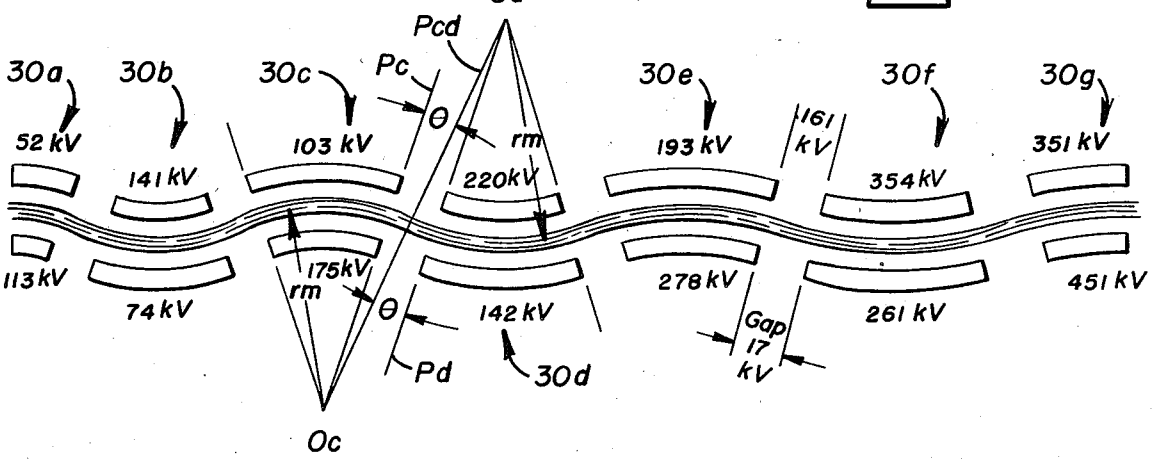
FIG. 6 is a schematic view of the TFF accelerator section of FIG. 1, illustrating the design of the accelerator.

With the mean potential of each successive pair of electrodes being the same, the negative ions will be transported through the pairs of plates as a thin sheet without acceleration. If, however, the mean potential of successive pairs of electrodes is progressively increased, then the system will cause acceleration of the beam. Such a system is illustrated in FIG. 6, wherein seven pairs of electrodes **30*a*–30*g*** are used to accelerate the negative-ion beam from 80 keV to 400 keV. The illustrated 6-gap system has an overall length of 92 cm and gives a 30% energy gain per stage without exceeding a field gap limit of 40 kV/cm.

FIG. 6 also illustrates the manner in which the lengths of the electrodes are determined, relative to each other in a pair and to the electrodes of the next pair. A plane $P_{cd}$ is defined by the axes of curvature $O_c$ and $O_d$ of electrodes pairs $30_c$ and $30_d$. Plane $P_c$, containing the axis of electrode pair $30_c$, and at an angle $\theta$ to plane$_{cd}$ will define the exit edges of the electrodes of electrode pair **30*c*. Likewise, plane $P_d$, containing the axis of pair 30*d*, and at the same angle $\theta$ to plane $P_{cd}$ will define the entry edges of electrode pair 30*d***. Angle $\theta$ is selected to be as small as possible while yet providing a sufficient gap between electrode pairs to prevent arcing therebetween. If the gap is such that the potential difference between electrodes does not exceed 40 kV/cm, a suitable safety factor wll be provided.

FIG. 4 additionally illustrates the manner in which the side edges of the sheet beam 50 can be confined by a suitable shaping of the side edges 38 and 39 of the electrodes. In general, the side edges of the inner and outer electrodes are bent, at 51 and 52, toward the axis of curvature in the vicinity of the side edges of the sheet beam 50. As seen in FIG. 4, such shaping will cause the equipotential lines, indicated by dashed lines 51, to be correspondingly shaped. The electric field force lines, indicated by dotted lines 52, are orthogonal to the equipotential lines and hence are angled downwardly and inwardly towards the center of the pair of electrodes, thus establishing an electric force vector acting horizontally inwardly towards the center of the electrodes in the vicinity of the side edge of the negative-ion beam 50 to oppose outward spreading of the beam.

The tendency of the beam 50 to spread outwardly is caused primarily by the fact that the ions in the beam are negatively charged and repel each other. This force is relatively small in comparison with the force required to curve the beam to follow the path $r_m$, so that only a small percentage, in the order of 10%, of the deflection field between the electrodes is required as a restoring field to provide the desired edge containment of the beam.

In order to prevent the beam from escaping outwardly from the plates while simultaneously preserving the balance of forces necessary to keep the beam near the midline of the curving electrodes, the electrodes are designed as follows. First, an appropriate field is specified along the y-axis of FIG. 4 (the midline of the beam). The example chosen for FIG. 4 is:

$$E_x(0, y)=E_m=\text{const.} \tag{9a}$$

$$E_y(0, y)=aE_m\text{sech}(\pi y/2s) \tag{9b}$$

where $s=G/(2-4a)$ is the position of a singularity, and a is the ratio of the restoring field to the deflection field. Then, from equations (9a) and (9b), one finds by analytic continuation a formula for equipotentials. Some of these are plotted as dashed lines 51 in FIG. 4 for $a=0.1$. The electrodes are shaped to fit particular equipotentials: the inner electrode surface 33 passes through the singularity at $x=-s$; the upper electrode surface 34 has the opposite potential with respect to the beam center.

The potential obtained from equations (9a) and (9b) is not quite constant along the midline (y-axis). Near the edge of the beam, the total potential is reduced by about 2%, which produces a discrepancy in the beam radius of about 1%. In some applications this would be acceptable. Otherwise the electrode shapes may be corrected to provide an increase in spacing up to 2% in the vicinity of the beam edge. With the corrected shape, the beam radius $2\phi/E$ is constant over the entire beam width.

Since the electric fields between the opposed electrodes in the transport or acceleration sections are designed with a strength sufficiently great as to guide the high energy negative ions in a curved path through the electrode pairs, low energy charged particles, such as ions or electrons created by beam collisions with gas molecules, will be immediately swept out by the transverse field. Such sweeping of low energy particles can avoid end-to-end breakdown in the accelerator section.

The foregoing description of a preferred embodiment has been presented for purposes of illustration and description. It is not intended to be exhaustive or to limit the invention to the precise forms disclosed, and obviously many modifications and variations are possible in light of the above teaching. For example, perforated or expanded metal plates may be used for either or both electrodes of a pair. The embodiments shown were shown and described in order to best explain the principles of the invention and its practical application to hereby enable others in the art to best utilize the invention in various embodiments and with various modifications as are suited to the particular use contemplated. Although the above description is directed to transport and acceleration of a negative-ion sheet beam for injection into a fusion reactor, the transverse field focusing apparatus described herein can be used for transport or acceleration of beams of other charged particles and for applications other than in conjunction with a fusion reactor. It is intended that the scope of the invention be defined by the claims appended hereto.

I claim:

1. In a sheet beam system of charged particles, a transverse field focused system comprising:

a plurality of pairs of spaced-apart inner and outer electrodes having concentric cylindrical-arc electrode surfaces with entry and exit edges parallel to the axis of curvature of said electrodes and side edges in planes perpendicular to said axis of curvature, said pairs of electrodes being arranged in serial manner with the exit edges of a pair of electrodes being spaced from and generally in line with the entry edges of the next pair of electrodes, means for impressing voltages on the electrodes of each pair thereof to create an electric field between said electrodes to guide said sheet beam of charged particles from the entry edges of said electrodes to the exit edges thereof and along a curved surface between said electrodes, the mean voltage on successive pairs of electrodes being progressively greater, and wherein both side edges of both electrodes of each pair thereof are bent toward the axis of curvature of said electrode surfaces to focus the beam edges.

2. In a sheet beam system of charged particles, a transverse field focused system comprising:

a pair of spaced-apart inner and outer electrodes having concentric cylindrical-arc electrode surface with entry and exit edges parallel to the axis of curvature of said electrodes and side edges in planes perpendicular to said axis of curvature, both side edges of both electrodes being bent toward the axis of curvature of said electrode surfaces to focus the beam edges, means for impressing voltages on the electrodes of said pair to create an electric field between said electrodes to guide said sheet beam of charged particles from the entry edges thereof to the exit edges thereof and along a curved surface between said electrodes, and wherein the outer electrode of said pair of electrodes comprises a plurality of spaced apart rods parallel to the axis of curvature of said pair.

3. In a sheet beam system of charged particles, a transverse field focused system comprising:

means forming a maze passage baffled to prevent a line of sight therethrough, a plurality of pairs of spaced-apart inner and outer electrodes having concentric cylindrical-arc electrode surfaces with entry and exit edges parallel to the axis of curvature of said electrodes and side edges in planes perpendicular to said axis of curvature, said pairs of electrodes being aranged in serial manner through the length of said maze passage, with the exit edges of a pair of electrodes being spaced from and generally in line with the entry of edges of the next pair of electrodes, means for impressing voltages on the electrodes of each pair thereof to create an electric field between said electrodes to guide said sheet beam of charged particles from the entry edges thereof to the exit edges thereof and along a curved surface between said electrodes, and wherein both side edges of both electrodes of each pair thereof are bent towards the axis of curvature of said electrode surfaces to focus the beam edges.

4. A transverse field focused system as set forth in claim 3, wherein the outer electrode of at least one pair thereof comprises a plurality of spaced apart rods parallel to the axis of curvature of said pair.

5. A transverse field focused system as set forth in claim 4, wherein both side edges of both electrodes of each pair thereof are bent towards the axis of curvature of said electrode surfaces to focus the beam edges.

* * * * *